United States Patent [19]

Bognar et al.

[11] 4,448,126

[45] May 15, 1984

[54] INKER FOR PRINTING PRESSES

[75] Inventors: Daniel Bognar, Wiesbaden; Friedrich Kuhnert, Heusenstamm, both of Fed. Rep. of Germany

[73] Assignee: Miller-Johannisberg Druckmaschinen GmbH, Wiesbaden, Fed. Rep. of Germany

[21] Appl. No.: 475,759

[22] Filed: Mar. 16, 1983

[30] Foreign Application Priority Data

May 26, 1982 [DE] Fed. Rep. of Germany ..... 3219655

[51] Int. Cl.[3] ..... B41F 31/14

[52] U.S. Cl. ..... 101/363; 101/426; 101/350

[58] Field of Search ..... 101/350, 351, 363, 205, 101/206, 207, 208, 209, DIG. 6, 349, 148, 426

[56] References Cited

U.S. PATENT DOCUMENTS 1,101,325 6/1914 Pearce et al. ..... 101/350
1,980,639 11/1934 Schlesinger ..... 101/350
2,672,093 3/1954 Meyer ..... 101/350
4,290,359 9/1981 Kapoor ..... 101/148

FOREIGN PATENT DOCUMENTS 505015 5/1939 United Kingdom ..... 101/350

*Primary Examiner*—Edgar S. Burr
*Assistant Examiner*—Charles A. Pearson

[57] ABSTRACT

An inking train for a printing press wherein an ink splitting cylinder acquires from an ink transporting roller preferably an approximate 50% portion of the ink load carried thereby whereby an approximate 50% portion of the ink load remains on the ink transporting roller; a pair of countercycling ductor rollers lift ink alternately from the ink transporting roller and the ink splitting cylinder and deposit the ink so lifted upon subsequent roller means in the inking train for subsequent recombining of the ink load portions upon a common roller for further transport thereof through the inking train.

13 Claims, 2 Drawing Figures

INKER FOR PRINTING PRESSES

BACKGROUND OF THE INVENTION

Figure 1:
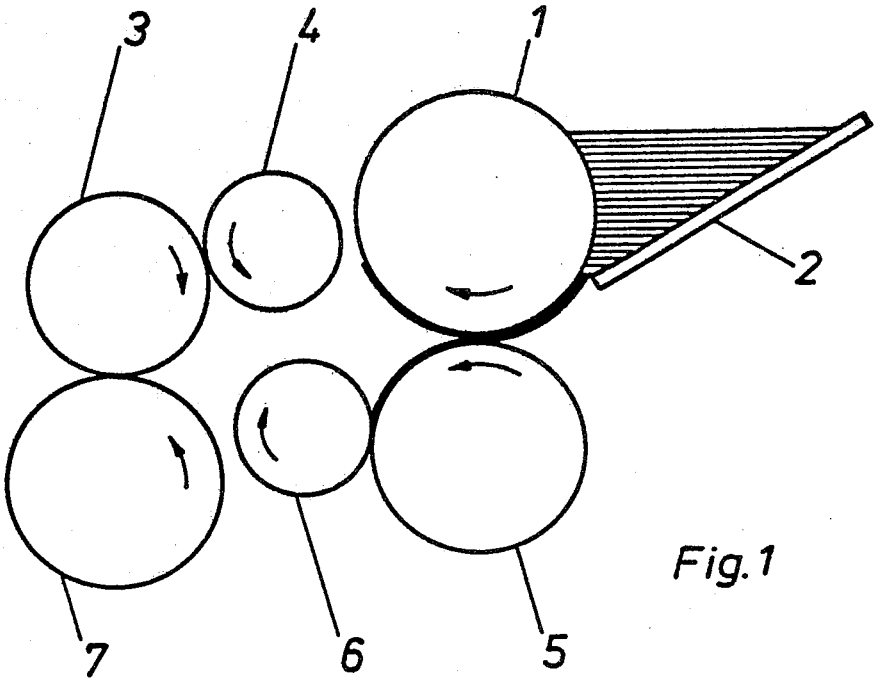

This invention concerns inking roller trains for printing presses. In the art of printing presses it is known to provide a train of serially engaged, ink transporting rollers, known collectively as an inking train, which operates to transfer printing ink from an ink fountain to a printing plate cylinder for the purpose of printing an image on a selected medium such as paper by contacting the printing plate cylinder with the medium to be printed.

For purposes of maintaining high print quality and uniformity, it is considered to be of paramount importance that the ink transferred from the ink fountain be applied to the printing plate cylinder with the greatest possible uniformity. Conventional inking trains have included a variety of ink fountain rollers, ductor rollers, vibrating cylinders, and various arrangements of other rollers, all intended to transfer ink uniformly from an ink fountain to a printing plate cylinder.

With the advent of increasing printing press operating speeds it has become increasingly difficult to control and maintain the ink transfer uniformity required for high print quality. For example, many printing presses utilize ductor rollers with alternately contact a pair of rollers such as an ink fountain roller and a subsequent roller, for example, a vibrating cylinder, to transfer ink therebetween. At higher operating speeds, kinetic and kinematic limitations begin to adversely influence the ability of such a ductor roll to transfer ink with adequate uniformity. These and other limitations related to press operating speed thus may have an adverse impact on print quality at higher operating speeds.

Proposed solutions to such problems, relating specifically to the action of ductor rollers, have included the suggestion that the ducting cycle time of the ductor roller be increased to provide fewer ducting cycles thereof in a given press operating cycle. For example, the ductor roller may be cycled to transfer ink from one roller to another only for every second print. This approach may not provide the desired uniformity in many instances as it requires that two impressions be created from a single inking. Thus, the second impression will exhibit a different degree of contrast and line definition than the first.

According to another proposed solution, two ductor rollers operating in alternating or counter-cycle fashion alternately lift ink from a common ink fountain roll which receives the ink directly or indirectly from an ink fountain. This proposed solution also may adversely affect print uniformity as one of such alternately cycling ductor rollers will consistently carry less ink than the other because both are lifting ink from the surface of a common roller. Accordingly, in this instance also the prints or impressions may not be of consistent uniformity or quality.

SUMMARY OF THE INVENTION

The present invention contemplates an improved inking train which overcomes the above-mentioned shortcomings of the prior art and provides for a high degree of inking uniformity in high speed applications where the achievement of such uniformity has often evaded the prior art technology. According to a preferred embodiment of this invention, an ink fountain roller is maintained in continuous rotary contact with an ink splitting cylinder during press operation whereby approximately 50% of the ink deposited by an ink blade or other source onto the ink fountain roller is diverted onto the ink splitting cylinder and the remaining 50% of the ink remains on the ink fountain roller surface to be transferred by a ductor roller to a subsequent roller such as a vibrating cylinder. A second ductor roller alternately contacts the ink splitting cylinder and a second subsequent roller to transfer the 50% of the ink carried on the ink splitting cylinder to such second subsequent roller. Preferably, one of the mentioned subsequent rollers transfers its ink load, received from one of the ductor rollers, to the other of the subsequent rollers whereby the entire ink load is distributed upon the surface of such other subsequent roller for further transfer through the inking train to the printing plate cylinder. The ductor rollers operate in counter-cycle fashion to alternately contact their respective source rollers and the respective subsequent rollers in the inking train. The circumferential speeds of the various rollers are so coordinated to provide for desirably uniform metering and distribution of the ink for uniform application of the ink to the printing plate cylinder. Such coordination of the roller speeds includes the possibility of having the ink fountain roller and the ink splitting cylinder driven at the same or at different circumferential speeds, and for having the described subsequent rollers driven at the same or at different circumferential speeds than the respective ductor rollers.

It is therefore an object of this invention to provide an inking train for a printing press wherein an ink splitting cylinder continuously contacts the ink fountain roller whereby ink deposited by the ink blade or other source on the ink fountain roller is diverted, approximately in a 50% or 1 to 1 proportion, onto the ink splitting cylinder.

Another object of the invention is to provide for such an ink fountain roller and a cooperating ink splitting cylinder, separate ductor rollers for transferring ink therefrom to subsequent rollers in the inking train.

Yet another object of the invention is to provide an inking train wherein a portion of the ink supply is diverted, approximately in a 50% or 1 to 1 proportion, from an ink fountain roller onto an ink splitting cylinder, and thence is transferred through the inking train to be recombined on a common roller with the other 50% of the ink which had remained on the ink fountain roller and was transferred independently to the common roller.

Figure 2:
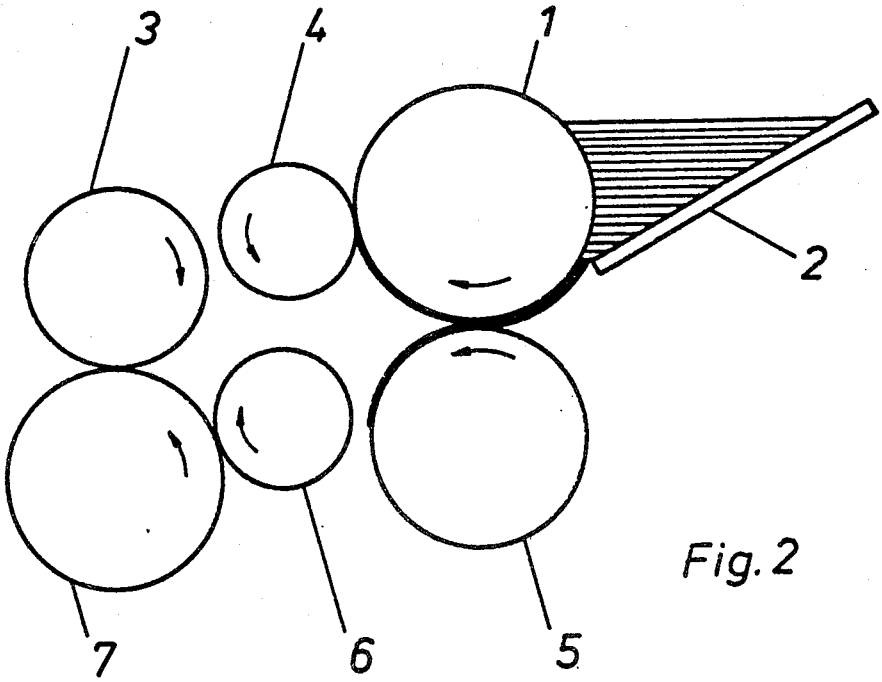

These and other objects and advantages of the invention will become more readily apparent upon a reading of the following detailed description taken in conjunction with the accompanying figures, in which:

FIG. 1 is a schematic side elevation of a portion of an inking train including an ink splitting cylinder and other aspects of the present invention; and FIG. 2 is a schematic side elevation similar to FIG. 1 and showing the ductor rollers of the inking train in other operative positions than shown in FIG. 1.

There is generally indicated in FIG. 1 a portion of an inking train for a printing press according to a presently preferred embodiment of this invention and including a plurality of serially engageable ink transporting rollers and cylinders. In such an inking train the various ink transporting rollers are disposed on parallel axes of rotation for rotation thereabout with the directions of roller rotation being indicated by the directional arrows depicted on the respective rollers in FIGS. 1 and 2.

In FIG. 1 a first ink transporting roller is shown as an ink fountain roller 1, which is located in juxtaposition with an ink blade 2 that is cooperable with ink fountain roller 1 to feed ink from a reservoir onto the surface of the ink fountain roller 1 in the known manner. An ink splitting cylinder or ink splitter 5 is maintained in juxtaposition with the ink fountain roller 1 and continuously in surface contact therewith for rotation therewith in the rotary direction indicated by the directional arrows depicted in FIGS. 1 and 2 on the respective rollers. The relative circumferential speeds of the engaged surfaces of ink fountain roller 1 and ink splitter 5 may be the same or different. As a result of such rotary surface contact, an ink division is achieved wherein the ink load deposited on ink fountain roller 1 by ink blade 2 is split, approximately in a 50% or 1 to 1 proportion, between the ink fountain roller 1 and the ink splitter 5.

A pair of ductor rollers or ink ductors 4 and 6 engage ink fountain roller 1 and ink splitter 5, respectively, in alternating fashion. Each ink ductor 4 and 6 intermittently engages its respective ink source or supply roller (rollers 1 and 5, respectively) to acquire the ink load therefrom. Accordingly, in FIG. 1 ink ductor 6 is shown in contact with ink splitter 5 whereas in FIG. 2 ink ductor 6 is disengaged from ink splitter 5 and ink ductor 4 is engaged with ink fountain roller 1.

Each ink ductor 4 and 6 intermittently engages a subsequent roller in the ink train in rotary engagement to transfer the ink lifted from the respective source roller to such subsequent roller. Accordingly, in FIG. 1 ink ductor 4 is engaging a subsequent or intermediate roller 3, which may be a vibrating cylinder for example, while ink ductor 6 is engaging ink splitter 5 to lift the ink load therefrom. A subsequent point in the ink train operating cycle is shown in FIG. 2 wherein the ink ductor 4 has been moved from engagement with vibrating cylinder 3 into engagement with ink fountain roller 1 to lift additional ink therefrom while ink ductor 6, which has just acquired a load of ink from ink splitter 5, has been moved into engagement with another subsequent or intermediate roller such as another vibrating cylinder 7.

It will be seen that the ductors 4 and 6 operate in counter-cycle fashion or out of phase with each other in a manner that a uniform supply of ink, either from the ink splitter 5 or from the ink fountain roller 1 is being transferred uniformly through the ink train during press operation. As shown, roller 3 continuously engages roller 7 whereby the ink supply transferred by ink ductors 4 and 6 from ink fountain roller 1 and ink splitter 5, respectively, is recombined and distributed upon the surface of one of rollers 3 and 7, for transport thereof through the remainder of the inking train, which may comprise one or more additional ink transfer rollers.

According to the description hereinabove there is provided by the instant invention an improved inking train for a printing press wherein an ink splitting cylinder engages a main ink fountain roll to achieve a division or split of the ink between the two rollers, approximately in a 50% or 1 to 1 proportion. The invention thus permits both the ink fountain roller and the ink splitting cylinder to present a relatively uniform ink load to a pair of counter-cycling, ductor rollers for transfer of the ink load thereby to subsequent rollers in the inking train. The respective ink loads transferred by the ductor rollers are recombined on a common cylinder or roller for eventual application to a printing plate cylinder at the end of the inking train.

Inasmuch as the invention is intended to be limited only by the scope of the claims appended hereto, it will be appreciated that alternative embodiments and modifications may be incorporated without departing from the spirit of the invention. For example, the inking train may comprise any number of subsequent rollers beyond the ductor rollers 4 and 6, as desired; additionally, the ink splitter roll need not necessarily engage the main ink fountain roll but may alternatively engage a subsequent roll which is receiving substantially the entire ink load of the main ink fountain roller. The invention as described therefore may be incorporated in printing presses with inking trains of widely varying design specifications and details.

I claim:

1. In an inking train for a printing press wherein a serial plurality of rotatable rollers cooperate to transport ink from an ink fountain through the inking train for repetitive printing of inked impressions upon a printing medium, the combination comprising; an ink transporting roller which receives an ink output from such ink fountain; an ink splitting cylinder which contacts said ink transporting roller to acquire therefrom a first portion of such ink output while a second portion of such ink output remains on a surface portion of said ink transporting roller; a first ink ductor roller intermittently engageable with said ink splitting cylinder to intermittently acquire therefrom an ink load comprising substantially all of said first portion of such ink output; a second ink ductor roller intermittently engageable with said surface portion of said ink transporting roller to intermittently acquire therefrom an ink load comprising substantially all of said second portion of such ink output; and subsequent roller means cooperable with said first and second ductor rollers to recombine their respective ink loads upon a common ink transporting roller for further transport of such entire ink output through such inking train.

2. The combination as claimed in claim 1 wherein said first and second portions of such ink load are approximately equal portions.

3. The combinations as claimed in claim 1 wherein said first and second ductor rollers are intermittently engageable with said subsequent roller means.

4. The combination as claimed in claim 1 wherein said first and second ductor rollers are alternately engageable with said subsequent roller means.

5. The combination as claimed in claim 4 wherein said first and second ductor roller are operable in countercycle fashion whereby when one of said first and second ductor rollers is acquiring an ink load the other of said first and second ductor rollers is delivering its ink load to said subsequent roller means.

6. The combination as claimed in claim 5 wherein said subsequent roller means includes a first subsequent roller for receiving the ink load of said first ductor roller and a second subsequent roller for receiving the ink load of said second ductor roller.

7. The combination as claimed in claim 6 wherein said first and second subsequent rollers are rotatably engaged in surface contact with each other.

8. The combination as claimed in claim 7 wherein said first and second subsequent rollers are distributor cylinders.

9. The combination as claimed in claim 8 wherein said ink transporting roller is an ink fountain roller cooperable with such an ink fountain to directly receive ink therefrom.

10. In a printing press wherein an inking train comprised of a serial plurality of cooperable rollers transports ink from an ink fountain through the inking train, the method of transporting ink through at least a portion of such inking train comprising the steps of: depositing an ink load on a first ink transporting roller; directing a portion of the ink load on said first ink transporting roller onto a second ink transporting roller in constant contact with said first ink transfer roller while retaining a portion of the ink load on the first ink transporting roller; intermittently and alternately engaging said first and second ink transporting rollers with ductor roller means to lift substantially all the ink therefrom; depositing the ink lifted from said first and second ink transporting rollers upon a subsequent roller means; and recombining the ink deposited upon said subsequent roller means on one roller of said subsequent roller means.

11. The method as claimed in claim 10 wherein an approximate 50% portion of the ink load on said first ink transporting roller is directed onto said second ink transporting roller.

12. The method as claimed in claim 11 wherein said depositing of ink lifting from said first and second ink transporting rollers upon a subsequent roller means includes the step of depositing the ink carried by said ductor roller means upon said subsequent roller means.

13. The method as claimed in claim 12 wherein said intermittently and alternately engaging said first and second ink transporting rollers with ductor roller means includes intermittently contacting each of said first and second ink transporting rollers with one of a pair of ink ductor rollers.

* * * * *

UNITED STATES PATENT AND TRADEMARK OFFICE

CERTIFICATE OF CORRECTION

PATENT NO. : 4,448,126

DATED : May 15, 1984

INVENTOR(S) : Daniel Bognar & Friedrich Kuhnert

It is certified that error appears in the above-identified patent and that said Letters Patent are hereby corrected as shown below:

Column 6, line 8, "lifting" should be --lifted--.

Signed and Sealed this

*Second* Day of *October 1984*

[SEAL]

*Attest:*

GERALD J. MOSSINGHOFF

*Attesting Officer*

*Commissioner of Patents and Trademarks*